US011946171B2

(12) United States Patent
Du

(10) Patent No.: US 11,946,171 B2
(45) Date of Patent: Apr. 2, 2024

(54) YARN, APPARATUS AND METHODS PREPARING THEREOF

(71) Applicant: TVN Investment Limited, Tortola (VG)

(72) Inventor: Hongzhuan Du, Zhanjiang (CN)

(73) Assignee: TVN Investment Limited, Tortola (VG)

( * ) Notice: Subject to any disclaimer, the term of this patent is extended or adjusted under 35 U.S.C. 154(b) by 122 days.

(21) Appl. No.: 17/664,498

(22) Filed: May 23, 2022

(65) Prior Publication Data

US 2022/0282406 A1 Sep. 8, 2022

Related U.S. Application Data

(63) Continuation-in-part of application No. 16/451,100, filed on Jun. 25, 2019, now abandoned.

(30) Foreign Application Priority Data

Nov. 28, 2018 (CN) ..... 201811436596.4

(51) Int. Cl.
*D02G 3/38* (2006.01)
*D02G 3/36* (2006.01)
*D02G 3/28* (2006.01)

(52) U.S. Cl.
CPC ..... *D02G 3/38* (2013.01); *D02G 3/367* (2013.01); *D02G 3/28* (2013.01)

(58) Field of Classification Search
CPC ..... D02G 3/36; D02G 3/367; D02G 3/38
(Continued)

(56) References Cited

U.S. PATENT DOCUMENTS 3,092,953 A * 6/1963 Blackstock ..... D02G 3/324 57/12
3,264,816 A * 8/1966 Jaggi ..... D02G 3/324 57/228

(Continued)

FOREIGN PATENT DOCUMENTS

JP 57-106728 A 7/1982
JP 2008214812 A 9/2008
JP 2011526330 A 10/2011

OTHER PUBLICATIONS

Office Action of 2021-531356 issued from the Japan Patent Office dated Jan. 30, 2023.

*Primary Examiner* — Shaun R Hurley
(74) *Attorney, Agent, or Firm* — S&F/WEHRW

(57) ABSTRACT

The present disclosure provides composite yarn, apparatus and methods preparing thereof. The composite yarn of the present disclosure includes wrapping fibers and a central yarn that is formed by a first body yarn and a second body yarn, wherein a portion of the wrapping fibers are combined with the central yarn in at least one of the following states: a first state, a portion of the wrapping fibers wrap around the first body yarn or the second body yarn; a second state, a portion of the wrapping fibers wrap around the first body yarn and the second body yarn respectively at the same time; a third state, a portion of the wrapping fibers wrap around the central yarn. The composite yarn of the present disclosure has low twist factor and high strength, which solves the problem of severe strength loss associated with low twist factors existing in conventional low-twist techniques.

13 Claims, 8 Drawing Sheets

(58) Field of Classification Search
USPC ..... 57/224
See application file for complete search history.

(56) References Cited

U.S. PATENT DOCUMENTS 3,365,872 A * 1/1968 Field, Jr. ..... D02G 3/367 57/328
3,367,095 A * 2/1968 Field, Jr. ..... D02G 3/367 57/328
3,596,459 A * 8/1971 Wada ..... D02G 3/367 57/313
4,100,727 A * 7/1978 Hamel ..... D02G 3/367 57/210
4,384,448 A * 5/1983 Wilkie ..... D01H 7/90 57/328
4,414,800 A * 11/1983 Nakayama ..... D02G 3/281 57/236
4,484,436 A * 11/1984 Nakayama ..... D01H 7/90 57/328
4,495,760 A * 1/1985 Vanhelle ..... D02G 3/367 57/12
4,903,472 A * 2/1990 Vanhelle ..... D02G 3/367 57/280
H1225 H * 9/1993 Foy ..... 57/328
5,568,719 A * 10/1996 Proctor ..... D02G 3/367 57/328
6,370,858 B1 * 4/2002 Mori ..... D02G 3/367 57/17
7,913,483 B2 * 3/2011 Qiu ..... D02G 3/367 57/18
10,161,066 B2 * 12/2018 Yeung ..... D01H 1/025
2005/0055997 A1 * 3/2005 Bader ..... D02G 3/367 57/224
2010/0162677 A1 * 7/2010 Qiu ..... D02G 3/367 57/12
2018/0245249 A1 * 8/2018 Yenici ..... D02G 3/32

* cited by examiner

YARN, APPARATUS AND METHODS PREPARING THEREOF

CROSS-REFERENCE TO RELATED APPLICATIONS

This is a continuation-in-part of the U.S. non-provisional patent application Ser. No. 16/451,109 filed Jun. 25, 2019, which claims the benefit of priority of China Patent Application Number 201811436596.4, filed Nov. 28, 2018, the content of which being hereby incorporated by reference in its entirety for all purposes.

TECHNICAL FIELD

The present disclosure relates to low-twist-high-strength composite yarns, apparatus and methods of production thereof.

BACKGROUND

Twist is needed in fibers, filaments, or yarns to hold the fibers together, and is added in the spinning and plying processes. The amount of twist varies depending on the fibers, thickness of yarn, preparation of fiber, manner of spinning, and the desired result. The amount of twist in a yarn helps to define the style of yarn—a yarn with a lot of air such as a wollen-spun yarn will have much less twist than a yarn with little air such as a worsted-spun yarn. The amount of twist (or the twist factor) also affects the yarn in terms of stretchiness, strength, halo, and many other attributes. Filling or weft yarns usually have fewer twists per inch (lower twist factor) because strength is not as important as with warp yarns, and highly twisted yarns are, in general, stronger.

Yarns with low twist factors are generally soft and fluffy, but with severe loss in their strength. On the other hand, twist factors of yarns made by existing low-twist techniques are still relatively high. For example, the twist factor of cotton yarns is higher than 2.0, wherein the twist factor is calculated by dividing the number of twist per inch by the square root of the yarn count (Ne). Moreover, existing low-twist techniques have limited applicability. In particular, only fibers with certain length (e.g. longer than 28 mm) and certain thickness can be used to form required yarns with the existing low-twist techniques, whereas some synthetic chemical short fibers cannot be used, and this undermines the flexibility of material selection and poses an economic burden for making low-twist yarns.

In addition, while low-twist yarns with soft and fluffy textures are popular in the market, the low strength commonly resulting therefrom has been a problem.

Therefore, there is a need for developing a low-twist-high-strength yarn. There is also a need for developing a method and apparatus for making the low-twist-high-strength yarn, where the apparatus and the method using thereof have high flexibility in material selection, such as the use of short fibers regardless of their lengths and thicknesses.

SUMMARY OF THE INVENTION

Provided herein are improved low-twist-high-strength yarn, an apparatus for making thereof, and a method using the apparatus for making the low-twist-high-strength yarn. The low-twist-high-strength yarn of the present disclosure has at least one of the following advantages: soft and fluffy hand touch, flexible selection for raw materials, and high strengths.

In a first aspect of the present disclosure, provided herein is a composite yarn 2, comprising a central yarn 18 and wrapping fibers 19, wherein the central yarn 18 comprises a first body yarn 16*a* and a second body yarn 16*b*; and wherein the wrapping fibers 19 are combined with the central yarn 18 in at least one of the following states: a first state: a portion of the wrapping fibers 19 wraps around the first body yarn 16*a* or the second body yarn 16*b*; a second state: a portion of the wrapping fibers 19 wraps around the first body yarn 16*a* and the second body yarn 16*b* respectively; and a third state: a portion of the wrapping fibers 19 wraps around the central yarn 18.

In a first embodiment of the first aspect of the present disclosure, the portion of the wrapping fibers 19 are combined with the central yarn 18 in both the first state and the third state, wherein the portion of the wrapping fibers 19 in the first state have a wrapping direction opposite to the wrapping direction of the portion of the wrapping fibers 19 in the third state.

In a second embodiment of the first aspect of the present disclosure, a first portion of the wrapping fibers 19 are combined with the central yarn 18 in the first state; a second portion of the wrapping fibers 19 are combined with the central yarn 18 in the second state; and a third portion of the wrapping fibers 19 are combined with the central yarn 18 in both the first state and the third state, wherein the third portion of the wrapping fibers 19 in the first state have a wrapping direction opposite to the wrapping direction of the third portion of the wrapping fibers 19 in the third state.

The combination of the wrapping fibers 19 with the central yarn 18 in at least one of the states described hereinabove is substantially by probability, i.e., either one or more of the first, second, and third states of combining the wrapping fibers 19 with the central yarn 18 according to the first or second embodiment of the first aspect of the present disclosure is/are randomly selected.

In a third embodiment of the first aspect of the present disclosure, the first body yarn 16*a* and the second body yarn 16*b* are arranged in parallel to form the central yarn 18.

In a fourth embodiment of the first aspect of the present disclosure, the first body yarn 16*a* and the second body yarn 16*b* twist with each other to form the central yarn 18.

In a fifth embodiment of the first aspect of the present disclosure, the first body yarn 16*a* has a yarn count of about 5-200 denier, and the second body yarn 16*b* has a yarn count of about 5-200 denier.

In a sixth embodiment of the first aspect of the present disclosure, the weight percentage of the first body yarn 16*a* and the second body yarn 16*b* to the total weight of the composite yarn 2 is about 60% to 65%.

In a seventh embodiment of the first aspect of the present disclosure, the twist factor of the central yarn 18 is about 0 to about 1.5.

In a second aspect of the present disclosure, provided herein is an apparatus for preparing the composite yarn described herein, comprising: at least one back roller 11*a* for infeeding at least one roving 12 comprising at least one short fiber 12*a*; at least one front roller 11*b* for infeeding a first filament 13*a*, a second filament 13*b* and the at least one roving 12 outfeeding from the at least one back roller, the at least one roving 12 being positioned between the first filament 13*a* and the second filament 13*b* at the at least one front roller 11*b*; and a false twisting device 14 in front of the at least one front roller 11*b* for infeeding the first filament

13*a* and the second filament 13*b* and the at least one roving 12 outfeeding from the at least one front roller 11*b*, so that the at least one roving 12 is combined with the first filament 13*a* and/or the second filament 13*b* to form the composite yarn 2, wherein the first filament 13*a* and the second filament 13*b* together form the central yarn 18 of the composite yarn 2, and the at least one short fiber 12*a* of the at least one roving 12 forms the wrapping fibers 19 of the composite yarn 2.

In a first embodiment of the second aspect of the present disclosure, the front roller 11*b* and the false twisting device 14 are configured to form a twisting triangle region between the front roller 11*b* and the false twisting device 14 so that a first portion of the at least one short fiber 12*a* of the at least one roving 12 wraps around the first filament 13*a* or the second filament 13*b* within the twisting triangle region, and a second portion of the at least one short fiber 12*a* of the roving 12 remains free.

In a second embodiment of the second aspect of the present disclosure, the composite yarn apparatus further comprises a winding device 20 in front of the false twisting device 14 for directly winding the composite yarn 2.

In a third embodiment of the second aspect of the present disclosure, the winding device 20 comprises a twisting element for twisting the composite yarn 2 during the winding.

In other embodiments, the false twisting device 14 is configured to form the composite yarn 2 with a lower twist amount than that of the central yarn 18 preliminarily formed by twisting the first and the second filaments (13*a*, 13*b*) within the twisting triangle region, such that when the first filament 13*a*, the second filament 13*b* and the at least one roving 12 pass through the false twisting device, a free portion of the short fibers 12*a* can wrap around the composite yarn 2 formed by the first filament 13*a*, the second filament 13*b*, and the roving 12 in an opposite direction to that of the portion of the short fibers 12*a* wrapping the first and/or second filaments (13*a*, 13*b*) within the twisting triangle region.

In certain embodiments, the higher the difference in twist amount (or twist factor) between the composite yarn 2 and the central yarn 18 is, the better is the false twisting effect, i.e., a high strength yarn with low twist.

In certain embodiments, the false twisting device 14 is a friction-type false twisting device having a contact surface roughness with respect to the infed filament(s) and/or yarn (s) in a range sufficient to result in a composite yarn with a desirable strength under a low-twist factor. The higher the contact surface roughness of the friction-type false twisting device is, the better is the false twisting effect exerted by the false twisting device on the resulting composite yarn.

In a third aspect of the present disclosure, provided herein is a method for preparing the composite yarn 2 using the apparatus described herein, comprising: infeeding a first filament 13*a* and a second filament 13*b* into the front roller 11*b*, wherein the first filament 13*a* and the second filament 13*b* are separated by a distance at the front roller 11*b* so that the first filament 13*a* and the second filament 13*b* form a twisting triangle region before entering the false twisting device 14; infeeding at least one roving 12 comprising at least one short fiber 12*a* into the back roller 11*a*, and outfeeding the at least one roving 12 from the front roller 11*b*, wherein the at least one roving 12 is positioned between the first filament 13*a* and the second filament 13*b* at the front roller 11*b*; infeeding the first filament 13*a* and the second filament 13*b* and the at least one roving 12 into the false twisting device 14 to form the composite yarn 2, wherein the first filament 13*a* forms the first body yarn 16*a*, the second filament 13*b* forms the second body yarn 16*b*, and the at least one short fiber 12*a* of the at least one roving 12 forms the wrapping fibers 19, the first body yarn 16*a* and the second body yarn 16*b* being arranged to form the central yarn 18, and the wrapping fibers 19 being combined with the central yarn 18 in at least one of the following ways: a first way: a portion of the wrapping fibers 19 wrap around the first body yarn 16*a* or the second body yarn 16*b*; a second way: a portion of the wrapping fibers 19 wrap around the first body yarn 16*a* and the second body yarn 16*b* respectively; and a third way: a portion of the wrapping fibers 19 wrap around the central yarn 18.

In a first embodiment of the third aspect of the present disclosure, the distance is about 1.0 mm to about 20 mm.

In a second embodiment of the third aspect of the present disclosure, the yarn count (Ne) of the central yarn (18) is about 2.5 to about 120.

In a third embodiment of the third aspect of the present disclosure, the portion of the wrapping fibers 19 are combined with the central yarn 18 in both the first way and the third way, wherein the portion of the wrapping fibers 19 in the first way have a wrapping direction opposite to the wrapping direction of the portion of the wrapping fibers 19 in the third way.

In certain embodiments, selection of one or more ways of combining a portion of the wrapping fibers 19 with one or more of the first body yarn 16*a*, the second body yarn 16*b*, and central yarn 18 is substantially by probability. What may affect the selection probability is the distance separating the first and the second filaments (13*a*, 13*b*) forming the twisting triangle region, the position of the at least one roving 12 between the first and the second filaments (13*a*, 13*b*) before being fed into the false twisting device, and/or the twist amount (twist factor) of the filaments/central yarn versus that of the composite yarn.

In a fourth embodiment of the third aspect of the present disclosure, in the second way, the wrapping directions of the portion of the wrapping fibers 19 around the first body yarn 16*a* and the second body yarn 16*b* are the same.

In a fifth embodiment of the third aspect of the present disclosure, the method described herein further comprises twisting the first filament 13*a* and the second filament 13*b* while infeeding the first filament 13*a* and the second filament 13*b* into the false twisting device 14.

In a sixth embodiment of the third aspect of the present disclosure, the method described herein further comprises directly winding the composite yarn 2.

In a seventh embodiment of the third aspect of the present disclosure, the method described herein further comprises twisting while winding the composite yarn 2.

BRIEF DESCRIPTION OF DRAWINGS

It should be understood that the drawings described herein are for illustration purposes only. The drawings are not necessarily to scale, with emphasis generally being placed upon illustrating the principles of the present teachings. The drawings are not intended to limit the scope of the present teachings in any way.

DETAILED DESCRIPTION OF THE INVENTION

The principles of the present disclosure are explained in conjunction with the following embodiments of the present disclosure. Detailed description of the embodiments and examples are provided in the present disclosure to enable those skilled in the art to practice the present disclosure. It should be understood that other embodiments may be utilized, and modifications may be made without departing from the spirit of the present disclosure.

Figure 1:
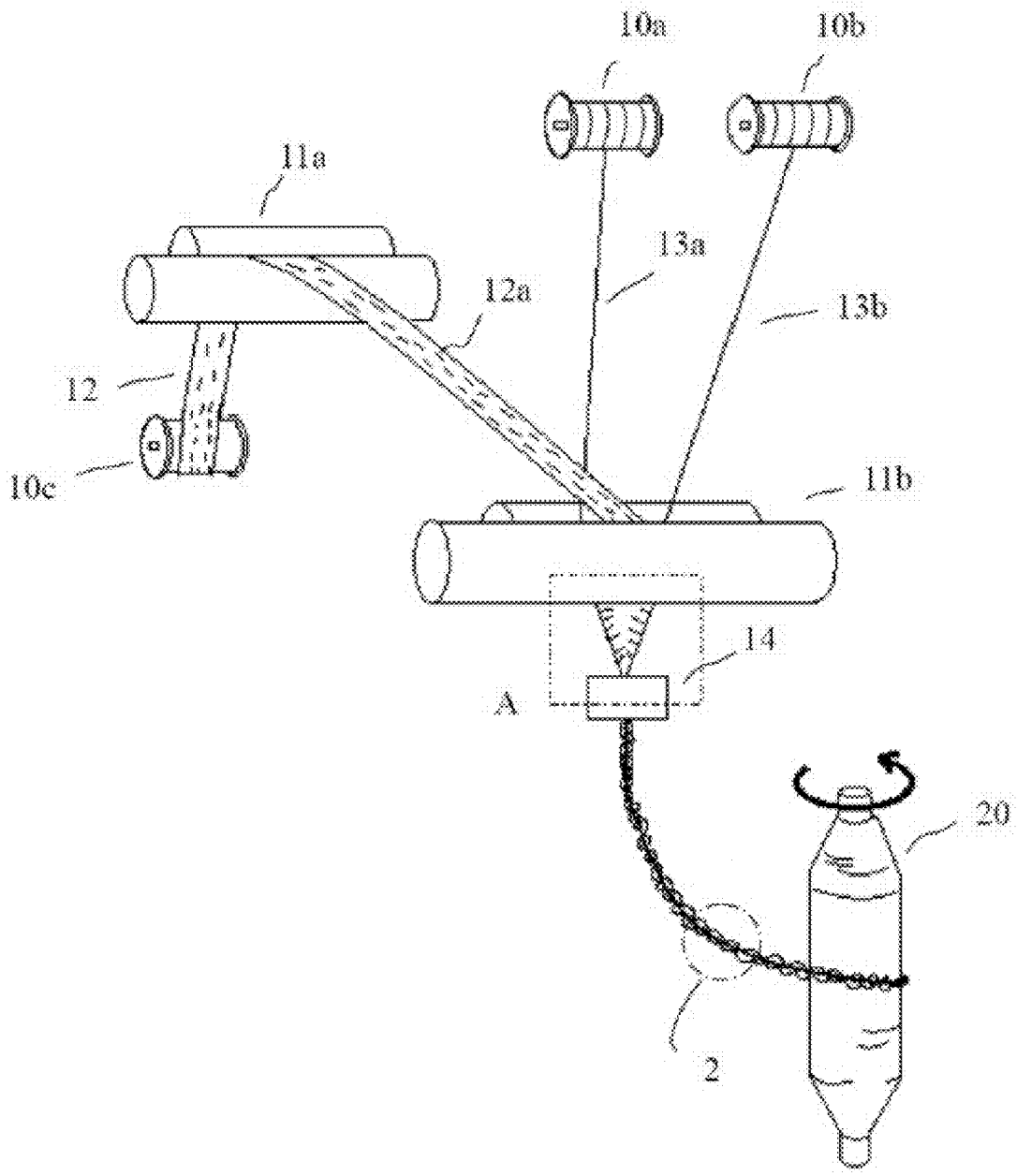
FIG. 1 shows the illustration of the apparatus for making the composite yarn according to certain embodiments described herein.

As shown in FIG. 1, the composite yarn apparatus of the present disclosure mainly comprises at least one back roller 11*a*, at least one roving bobbin 10*c* wound with at least one roving 12, at least one front roller 11*b*, and two filament bobbins 10*a* and 10*b* wound with filaments 13*a* and 13*b* behind the front roller 11*b*. The at least one roving bobbin 10*c* and the two filament bobbins 10*a* and 10*b* are arranged such that the roving 12 unwound from the roving bobbin 10*c* is located between the two filaments 13*a* and 13*b* unwound from the two filament bobbins 10*a* and 10*b* at the front roller 11*b*. In certain embodiments, the two filament bobbins 10*a* and 10*b* are located behind the back roller 11*a*, and the two filament bobbins 10*a* and 10*b* are located above the roving bobbin 10*c* and are respectively located at each side of the roving bobbin 10*c*. In certain embodiments, the two filament bobbins 10*a* and 10*b* are located in front of the back roller 11*a* and are respectively located at each side of the roving bobbin 10*c*. The two filament bobbins 10*a* and 10*b* can also be located below the roving bobbin 10*c* or in the same plane thereof. The distance between the two filaments 13*a* and 13*b* at the front roller 11*b* can be about 1 mm to about 20 mm, about 2 mm to about 19 mm, about 3 mm to about 18 mm, about 4 mm to about 17 mm, about 5 mm to about 16 mm, about 6 mm to about 15 mm, about 7 mm to about 14 mm, about 8 mm to about 13 mm, about 9 mm to about 12 mm, or about 10 mm to about 11 mm. In certain embodiments, the distance between the two filaments 13*a* and 13*b* at the front roller 11*b* is about 1.5 mm to about 3.5 mm. The selected distance between the two filaments 13*a* and 13*b* at the front roller 11*b* and where the roving 12 is positioned between the two filaments 13*a* and 13*b* in certain embodiments of the present invention will determine whether and how a portion of short fiber from the roving 12 wraps around any one or both of the two filaments 13*a* and 13*b* in the twisting triangle region.

The composite yarn apparatus of the present disclosure can further comprise a false twisting device 14 located in front of the front roller 11*b*. The false twisting device 14 of the present disclosure can be used for applying false twist onto the fibers, filaments, and/or yarns passing therethrough. The false twisting device 14 of the present disclosure can be a rubber false twisting device, a urethane false twisting device, an inlaid copper grooves and plastic false twisting device, or any other false twisting devices known to those skilled in the art that have false twisting functions.

Figure 2C:
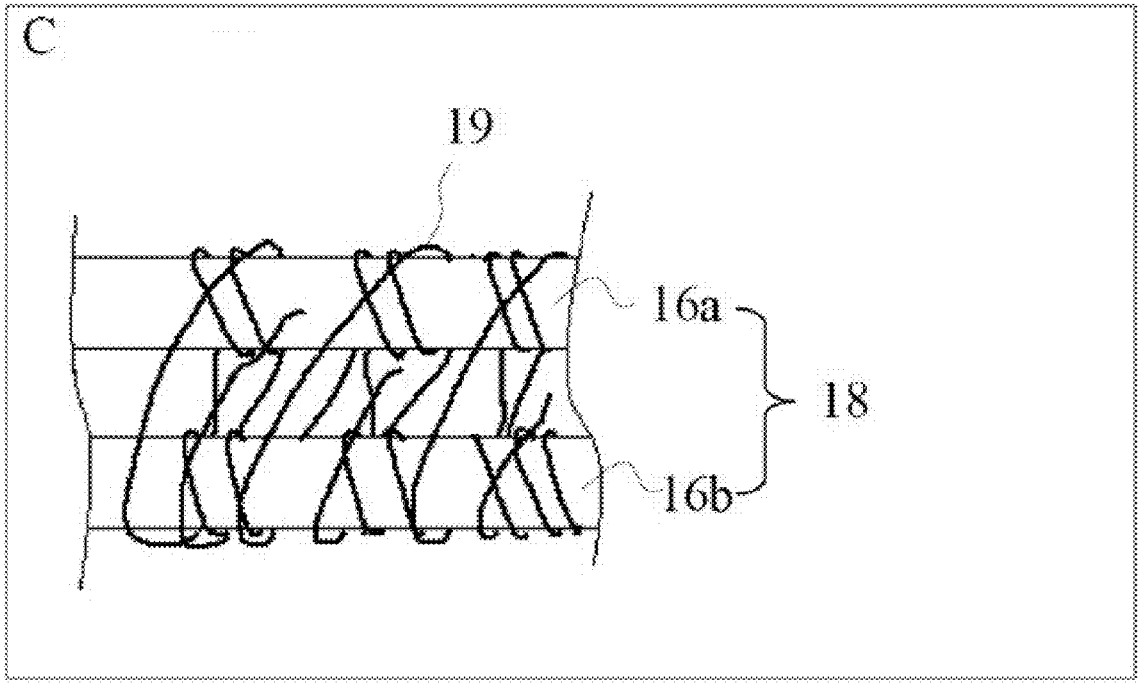
FIG. 2C shows the partial structural illustration of the composite yarn according to certain embodiments described herein.
Figure 3A:
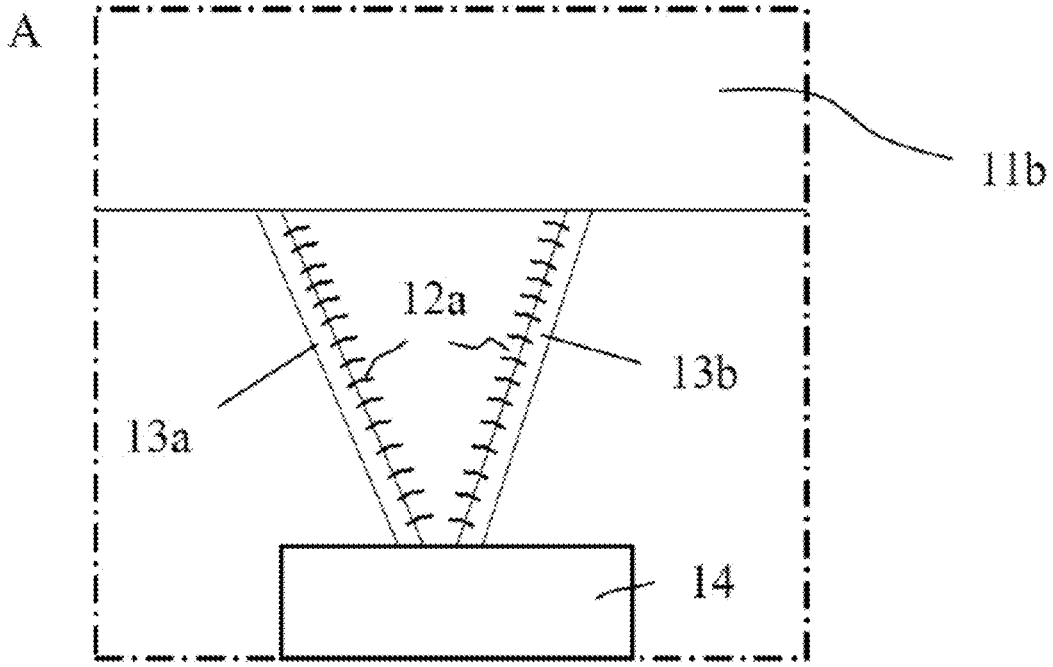
FIG. 3A shows the illustrations of the twisting triangle region of the composite yarn apparatus according to certain embodiments described herein.
Figure 3B:
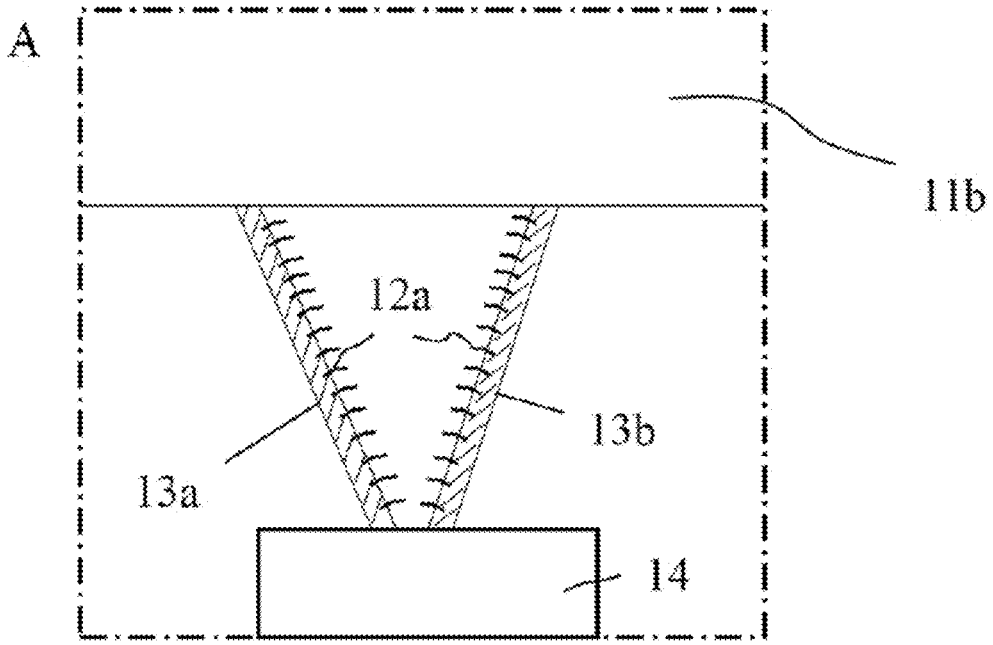
FIG. 3B shows the illustrations of the twisting triangle region of the composite yarn apparatus according to other embodiments described herein.
Figure 5A:
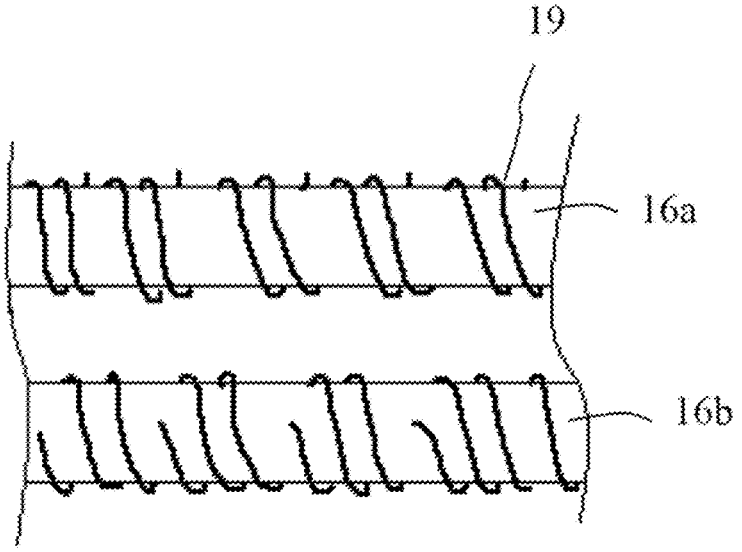
FIG. 5A shows the partial structural illustration of the composite yarn according to certain embodiments described herein.
Figure 5B:
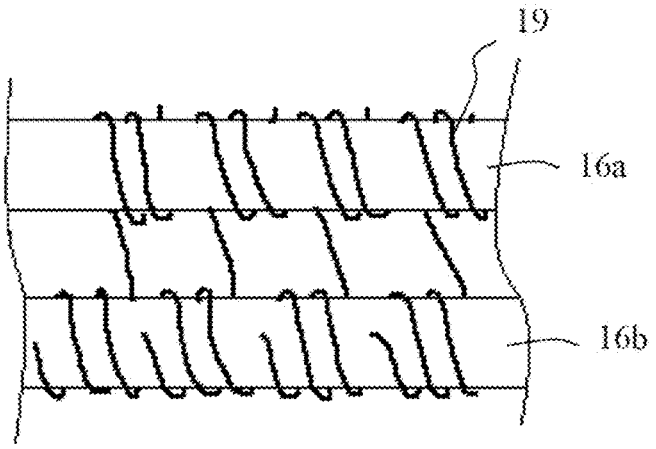
FIG. 5B shows the partial structural illustration of the composite yarn according to other embodiments described herein.
Figure 5C:
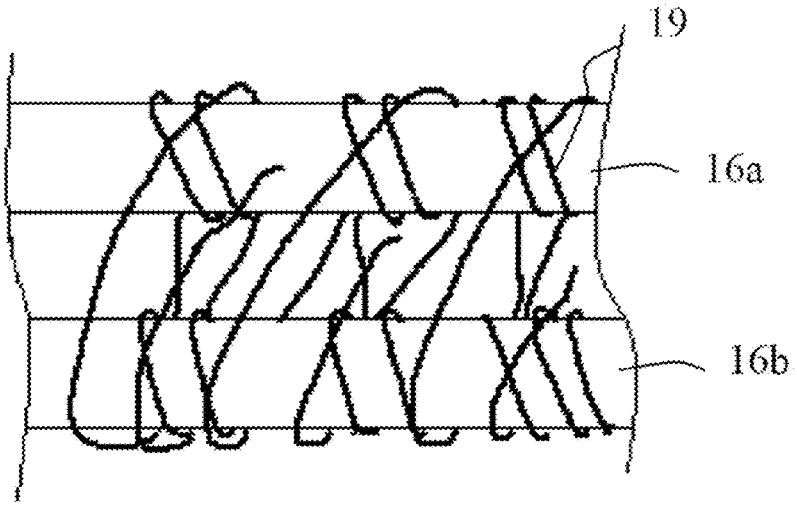
FIG. 5C shows the partial structural illustration of the composite yarn according to some other embodiments described herein.
Figure 6A:
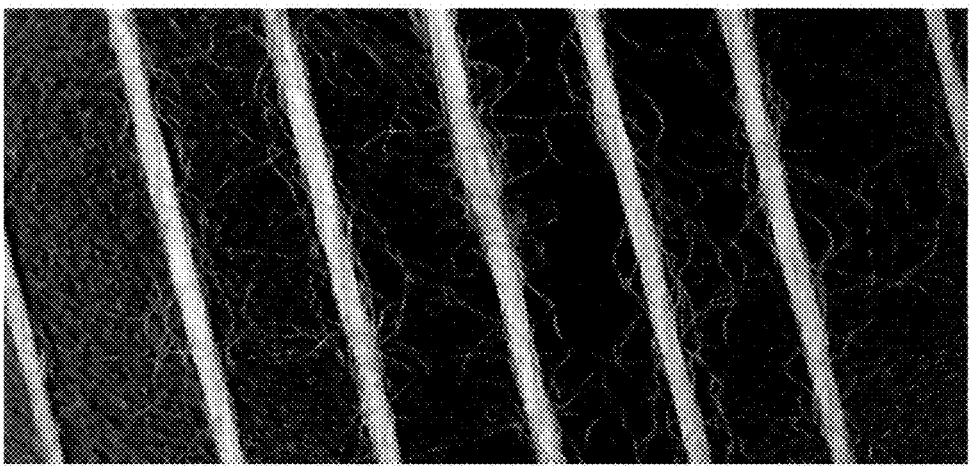
FIG. 6A shows an image of the composite yarn prepared according to certain embodiments described herein.
Figure 6B:
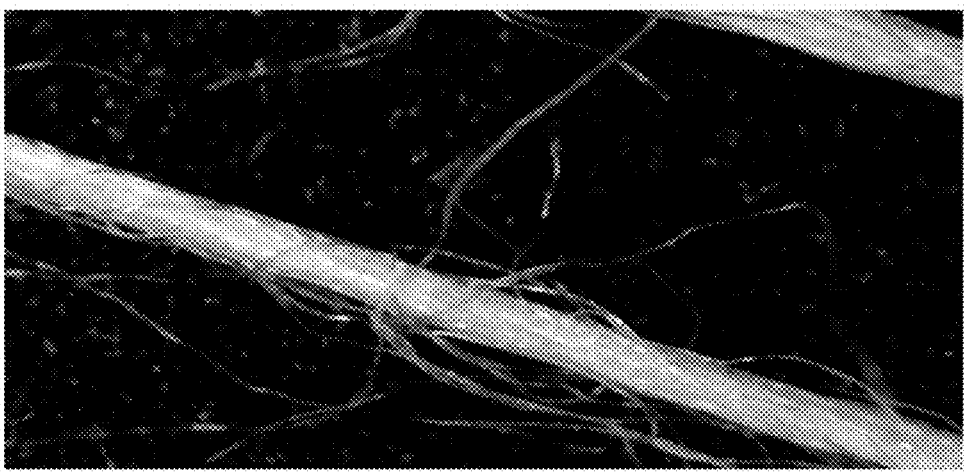
FIG. 6B shows an image of the composite yarn prepared according to other embodiments described herein.
Figure 6C:
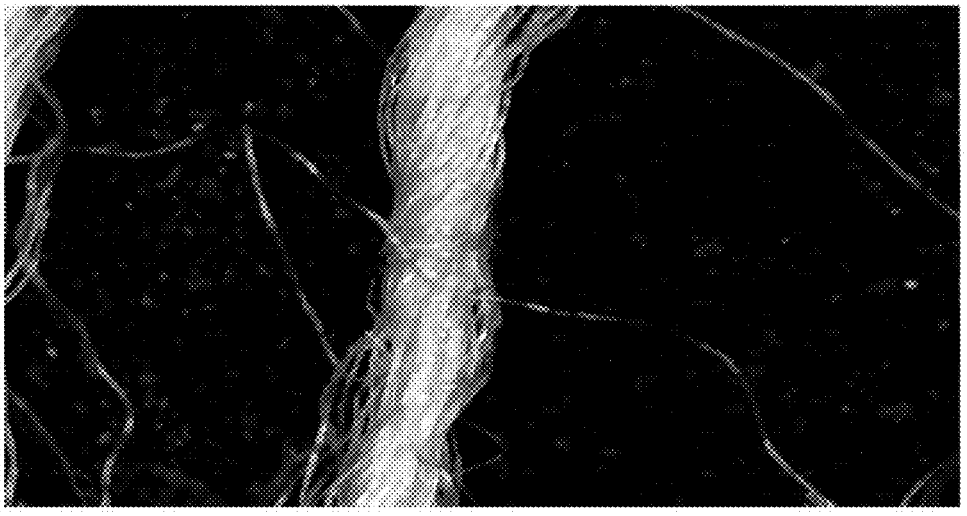
FIG. 6C shows an image of the composite yarn prepared according to some other embodiments described herein.

The false twisting device 14 in front of the front roller 11*b* can be arranged such that a twisting triangle region is formed between the front roller 11*b* and the false twisting device 14. The twisting triangle region allows the first filament 13*a*, the second filament 13*b*, and the at least one roving 12 comprising at least one short fiber 12*a* to be intertwined or combined in a special manner. In certain embodiments, one portion of the at least one short fiber 12*a* of the roving 12 wraps around the first filament 13*a* or the second filament 13*b*, and the other portion remains free, as shown in FIG. 3A and FIG. 3B. As shown in FIG. 3B, the twisting direction of the first filaments 13*a* can be Z or S, and the twisting direction of the second filaments 13*b* can be Z or S. The false twisting device 14 can be used for false twisting the first filament 13*a*, the second filament 13*b*, and the roving 12 comprising at least one short fiber 12*a* with one portion wrapping around the first filament 13*a* or the second filament 13*b* and the other portion being free, so that the free portion of the short fiber can wrap around the composite yarn formed by the first filament 13*a*, the second filament 13*b*, and the roving 12 in an opposite direction, as shown in FIGS. 2C, 5C, and 6C.

The composite yarn apparatus of the present disclosure can further comprise a winding device 20 located in front of the false twisting device 14. The winding device 20 can be used for directly winding the composite yarn of the present disclosure. The winding device 20 can further comprise a twisting element for twisting the composite yarn while winding the composite yarn.

During the operation, the first filament 13*a* and the second filament 13*b* are unwound from the first filament bobbin 10*a* and the second filament bobbin 10*b* before being fed into the frond roller 11*b* of the composite yarn apparatus of the present disclosure. The first filament 13*a* can be an elastic filament or an inelastic filament, such as a nylon filament, an acrylic filament, a polyester filament, a viscose filament, a spandex filament, or a silk filament; second filament 13*b* can also be an elastic filament or an inelastic filaments, such as a nylon filaments, an acrylic filament, a polyester filaments, a viscose filaments, a spandex filament, or a silk filament. In certain embodiments, the first filament 13*a* has a yarn count of about 5 denier to about 200 denier, about 15 denier to about 190 denier, about 25 denier to about 180 denier, about 35 denier to about 170 denier, about 45 denier to about 160 denier, about 55 denier to about 150 denier, about 65 denier to about 140 denier, about 75 denier to about 130 denier, about 85 denier to about 120 denier, or about 95 denier to about 110 denier. In certain embodiments, the first filament 13*a* has a yarn count of about 10 denier to about 180 denier. In certain embodiments, the second filament 13*b* has a yarn count of about 5 denier to about 200 denier, about 15 denier to about 190 denier, about 25 denier to about 180 denier, about 35 denier to about 170 denier, about 45 denier to about 160 denier, about 55 denier to about 150 denier, about 65 denier to about 140 denier, about 75 denier to about 130 denier, about 85 denier to about 120 denier, or about 95 denier to about 110 denier. In certain embodiments, the second filament 13*b* has a yarn count of about 10 denier to about 180 denier. The first filament 13*a* and the second filament 13*b* are separated by a distance at the front roller 11*b*, wherein the distance can be about 1 mm to about 20 mm, about 2 mm to about 19 mm, about 3 mm to about 18 mm, about 4 mm to about 17 mm, about 5 mm to about 16 mm, about 6 mm to about 15 mm, about 7 mm to about 14 mm, about 8 mm to about 13 mm, about 9 mm to about 12 mm, or about 10 mm to about 11 mm. In certain embodiments, the distance between the first filament 13*a* and the second filament 13*b* is about 1.5 mm to about 3.5 mm.

The roving 12 comprising at least one short fiber 12*a* can be unwound from the roving bobbin 10*c*, infed to the back roller 11*a*, and outfed from the front roller 11*b*. The positions of the roving 12 at the back roller 11*a* and the front roller 11*b* during infeeding can be determined so that the roving 12 is positioned between the first filament 13*a* and the second filament 13*b* at the front roller 11*b*. The short fibers of the roving 12 can be natural short fibers, including but not limited to cotton and wool. The short fibers of the roving 12 can be synthetic short fibers, including but not limited to polyamide and polyester. The short fibers of the roving 12 can also be regenerated short fibers, including but not limited to viscose fibers, cuprammonium fibers, acetate fibers, casein fibers, silk fibroin fibers, and soy protein fibers. The length of the short fibers can be greater than about 28 mm. In certain embodiments, the length of the short fibers can be no larger than about 28 mm, about 27 mm, about 26 mm, about 25 mm, about 24 mm, about 23 mm, about 22 mm, about 21 mm, about 20 mm, about 19 mm, about 18 mm, about 17 mm, about 16 mm, about 15 mm, about 14 mm, about 13 mm, about 12 mm, about 11 mm, about 10 mm, about 9 mm, about 8 mm, about 7 mm, about 6 mm, about 5 mm, about 4 mm, about 3 mm, about 2 mm, or about 1 mm. In certain embodiments, the length of the short fibers is about 25 mm to about 38 mm.

Figure 4A:
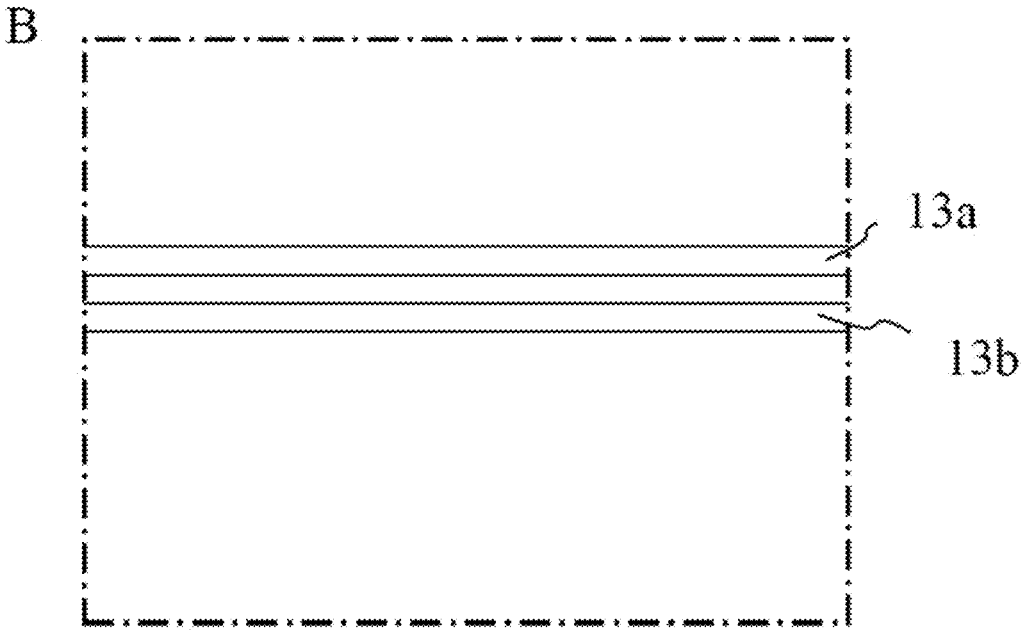
FIG. 4A shows the structural illustration of the central yarn of the composite yarn according to certain embodiments described herein.
Figure 4B:
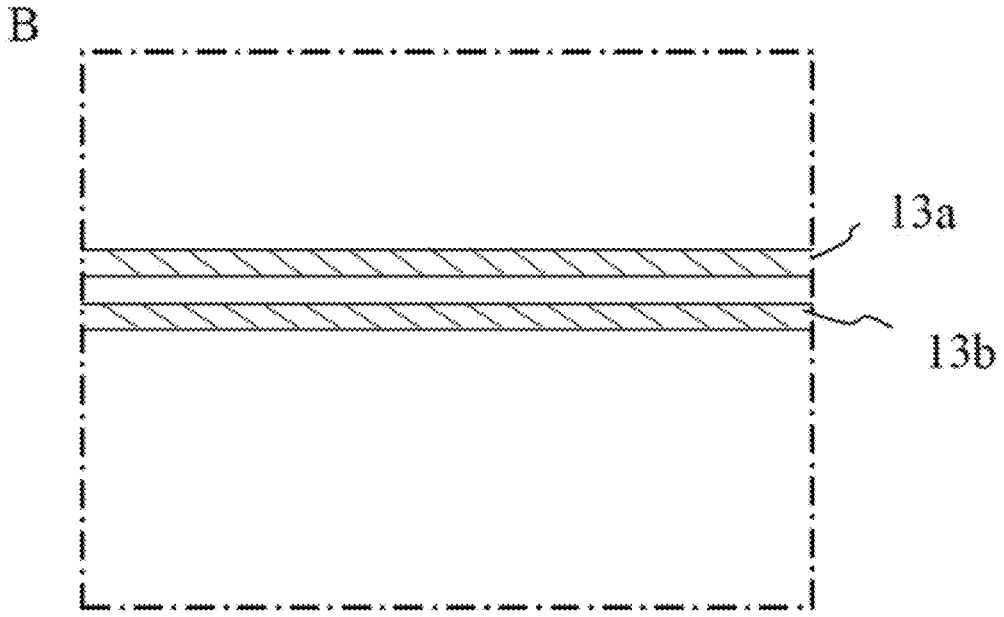
FIG. 4B shows the structural illustration of the central yarn of the composite yarn according to other embodiments described herein.

In certain embodiments, the roving 12 comprising the at least one short fiber 12*a* and the first filament 13*a* and the second filament 13*b* are combined within the twisting triangle region in the following manner: one portion of at least one short fiber 12*a* of the roving 12 wraps around the first filament 13*a* or the second filament 13*b*, and the other portion of at least one short fiber 12*a* of the roving 12 is free, as shown in FIGS. 3A and 3B. The length of the portion of the short fiber wrapping around the filament and the length of the portion of the short fiber being free can be about 1:1, about 1:2, about 1:3, about 1:4, about 1:5, about 1:6, about 1:7, about 1:8, about 1:9, about 1:10, about 10:1, about 9:1, about 8:1, about 7:1, about 6:1, about 5:1, about 4:1, about 3:1, or about 2:1. In certain embodiments, the twist factors of the first filament 13*a* and the second filament 13*b* within the twisting triangle region are about 0, as shown in FIGS. 3A and 4A. In certain embodiments, the twist factors of the first filament 13*a* and the second filament 13*b* within the twisting triangle region are greater than 0, which vary depending on the false twisting efficiency. As shown in FIGS. 3B and 4B, the twisting direction of the first filament 13*a* and the second filament 13*b* can be Z or S.

In certain embodiments, the first filament 13*a*, the second filament 13*b* and the roving 12 located within the twisting triangle region are fed into the false twisting device 14 for false twisting to form the composite yarn 2. As shown in FIG. 2C and FIGS. 5A-5C, the first filament 13*a* forms the first body yarn 16*a* of the composite yarn 2, the second filament 13*b* forms the second body yarn 16*b* of the composite yarn 2, and the at least one short fiber 12*a* of the roving 12 forms the wrapping fibers 19 of the composite yarn 2. The first body yarn 16*a* and the second body yarn 16*b* can be arranged to form the central yarn 18, wherein the yarn count (Ne) of the central yarn 18 is about 2.5 to about 120, about 12.5 to about 110, about 22.5 to about 100, about 32.5 to about 90, about 42.5 to about 80, or about 52.5 to about 70. A portion of the wrapping fibers 19 can be combined with the central yarn 18 in at least one of the following ways: a first way, as shown in FIG. 5A: a portion of the wrapping fibers 19 wrap around the first body yarn 16*a* or the second body yarn 16*b*, and the wrapping direction can be Z or S; a second way, as shown in FIG. 5B: a portion of the wrapping fibers 19 wrap around the first body yarn 16*a* and the second body yarn 16*b* respectively, and the wrapping direction can be Z or S; in certain embodiments, the wrapping directions of the portion of the wrapping fibers 19 around the first body yarn 16*a* and the second body yarn 16*b* are the same; and a third way: a portion of the wrapping fibers 19 wrap around the central yarn 18. In certain embodiments, the portion of the wrapping fibers 19 are combined with the central yarn 18 in both the first way and the third way, wherein the portion of the wrapping fibers 19 in the first way have a wrapping direction opposite to the wrapping direction of the portion of the wrapping fibers 19 in the third way, as shown in FIG. 5C. In certain embodiments, the wrapping fibers 19 of the composite yarn 2 are comprised of three portions, wherein the first portion of the wrapping fibers 19 are combined with the central yarn 18 in the first way; the second portion of the wrapping fibers 19 are combined with the central yarn 18 in the second way; and the third portion of the wrapping fibers 19 are combined with the central yarn 18 in both the first way and the third way, as shown in FIG. 6. The composite yarn 2 formed in the manner described herein has a special and novel structure with heterogeneous fiber distributions, which results in a composite yarn with low twist yet high strength. The term "body yarn" as used herein refers to one or more yarns that are constrained within the inner side of a composite yarn, wherein the "body yarn" can be a single filament, multiple filaments, or long yarns formed by short fibers. The term "wrapping fibers" as used herein refers to fibers that can constrain the body yarn of a composite yarn. The term "central yarn" as used herein refers to the yarns that are constrainedly positioned at or near the central axis of a composite yarn, which can be formed by one or more body yarns, and when the central yarn is formed by multiple body yarns, the multiple body yarns can contact directly with each other and intertwine together to form a central yarn, or the multiple body yarns can be arranged in parallel connected by a portion of the wrapping fibers to form a central yarn with the wrapping fibers as a binder.

The composite yarn outfed from the false twisting device 14 can be wound into a mass by the winding device 20. In certain embodiments, the composite yarn is wound into a mass directly. In certain embodiments, the composite yarn is twisted while being wound into a mass.

The composite yarn prepared by the methods and apparatus described herein has a structure with heterogeneous distribution of fibers. In particular, the twist factors of the composite yarn described herein can be approximately 0 with no loss or minimal loss in yarn strength, and the internal torque of the composite yarn described herein can be close to 0. In addition, compared to existing low twist techniques, which can only use long fibers (such as fibers with a length of greater than 28 mm) to make low-twist yarns, the methods described herein can choose a wider range of fiber materials and have no particular requirements on the length of fibers (fibers with a length of less than 28 mm can be used to make low-twist yarns). In other words, the yarn preparation methods described herein are more applicable in terms of the selection of fibers, and the composite yarns prepared thereof show properties of low twist yet high strength, which cannot be achieved by existing composite yarns. Moreover, the weight percentage of the filaments in the composite yarns prepared using the methods described herein can reach up to 60% to 65% with respect to the total weight of the composite yarn, which is advantageous as the price of filaments is generally lower than the price of rovings, making the composite yarns described herein more cost effective compared to existing yarns while not compromising the appearance and hand touch thereof.

In certain embodiments, the twist factor of the composite yarns 2 formed by the false twisting device is smaller than that of the central yarn 18 formed by the first and the second filaments (13*a*, 13*b*) or the filaments per se within the twisting triangle region.

As shown in FIG. 2A and FIGS. 6A-6C, the composite yarn of the present disclosure is a novel yarn with heterogeneous distribution of fibers. The term "heterogeneous distribution" of fibers refers to different wrapping status of fibers around the central yarn 18 formed by the first body yarn 16*a* and the second body yarn 16*b*. The central yarn 18 can be formed by arranging the first body yarn 16*a* and the second body yarn 16*b* in parallel. The central yarn 18 can also be formed by twisting the first body yarn 16*a* and the second body yarn 16*b* with each other. The first body yarn 16*a* can at least one elastic or inelastic filament such as nylon filaments, acrylic filaments, polyester filaments, viscose filaments, spandex, or silk. The second body yarn 16*b* can also be at least one elastic or inelastic filaments, such as nylon filaments, acrylic filaments, polyester filaments, viscose filaments, spandex, or silk. In certain embodiments, the first body yarn 16*a* has yarn count of about 5 denier to about 200 denier, about 15 denier to about 190 denier, about 25 denier to about 180 denier, about 35 denier to about 170 denier, about 45 denier to about 160 denier, about 55 denier to about 150 denier, about 65 denier to about 140 denier, about 75 denier to about 130 denier, about 85 denier to about 120 denier, or about 95 denier to about 110 denier. In certain embodiments, the first body yarn 16*a* has yarn count of about 10 denier to about 20 denier. In certain embodiments, the first body yarn 16*a* has yarn count of about 15 denier. In certain embodiments, the second body yarn 16*b* has yarn count of about 5 denier to about 200 denier, about 15 denier to about 190 denier, about 25 denier to about 180 denier, about 35 denier to about 170 denier, about 45 denier to about 160 denier, about 55 denier to about 150 denier, about 65 denier to about 140 denier, about 75 denier to about 130 denier, about 85 denier to about 120 denier, or about 95 denier to about 110 denier. In certain embodiments, the second body yarn 16*b* has yarn count of about 10 denier to about 20 denier. In certain embodiments, the second body yarn 16*b* has yarn count of about 15 denier.

In certain embodiments, the short fibers comprising the wrapping fibers 19 are combined with the central yarn 18 mainly in three states. The first state: the short fibers wrap around the first body yarn 16*a* or the second body yarn 16*b*, as shown in FIG. 5A; the second state: the short fibers wrap around the first body yarn 16*a* and the second body yarn 16*b* respectively, and the wrapping directions are the same (both Z twist or both S twist, as shown in FIG. 5B); the third state: the short fibers wrap around the first body yarn 16*a* and the central yarn 18 and the wrapping directions are opposite, or the short fibers wrap around the second body yarn 16*b* and the central yarn 18 and the wrapping directions are opposite, as shown in FIG. 5C. In certain embodiments, more fibers are combined with the central yarn 18 in the first state and the second state than fibers combined with the central yarn 18 in the third state. The short fibers can be natural short fibers, including but not limited to cottons and wools. The short fibers can also be synthetic short fibers, including but not limited to polyamides and polyesters. The short fibers can also be regenerated short fibers, including but not limited to viscose fibers, cuprammonium fibers, acetate fibers, casein fibers, silk fibroin fibers, and soy protein fibers. The length of the short fibers can be greater than about 28 mm. In certain embodiments, the length of the short fibers can be no larger than about 28 mm, about 27 mm, about 26 mm, about 25 mm, about 24 mm, about 23 mm, about 22 mm, about 21 mm, about 20 mm, about 19 mm, about 18 mm, about 17 mm, about 16 mm, about 15 mm, about 14 mm, about 13 mm, about 12 mm, about 11 mm, about 10 mm, about 9 mm, about 8 mm, about 7 mm, about 6 mm, about 5 mm, about 4 mm, about 3 mm, about 2 mm, or about 1 mm. In certain embodiments, the length of the short fibers is about 20 mm to about 38 mm.

Selection of one or more of the states to wrap the short fibers around any one or more of the first body yarn 16*a*, second body yarn 16*b* and central yarn 18 is substantially a random process. Factors that may determine the way or state of short fibers to wrap which of the first body yarn, second body yarn and central yarn include the distance between the two filaments of the first body and second body yarns, respectively, forming the twisting triangle region, position of the roving between the two filaments at the front roller, and/or whether the twist amount (or twist factor) of the central yarn or the first/second body yarn is higher or lower than the composite yarn.

In certain embodiments, the distance between the first and second filaments (13*a*, 13*b*) is from about 1.5 mm to about 3.5 mm; the roving is disposed substantially in the middle of the horizontal distance between the first and the second filaments (13*a*, 13*b*) at the front roller so that the probability of the short fibers to wrap the first body yarn, second body yarn and/or central yarn is substantially equal.

Figure 2A:
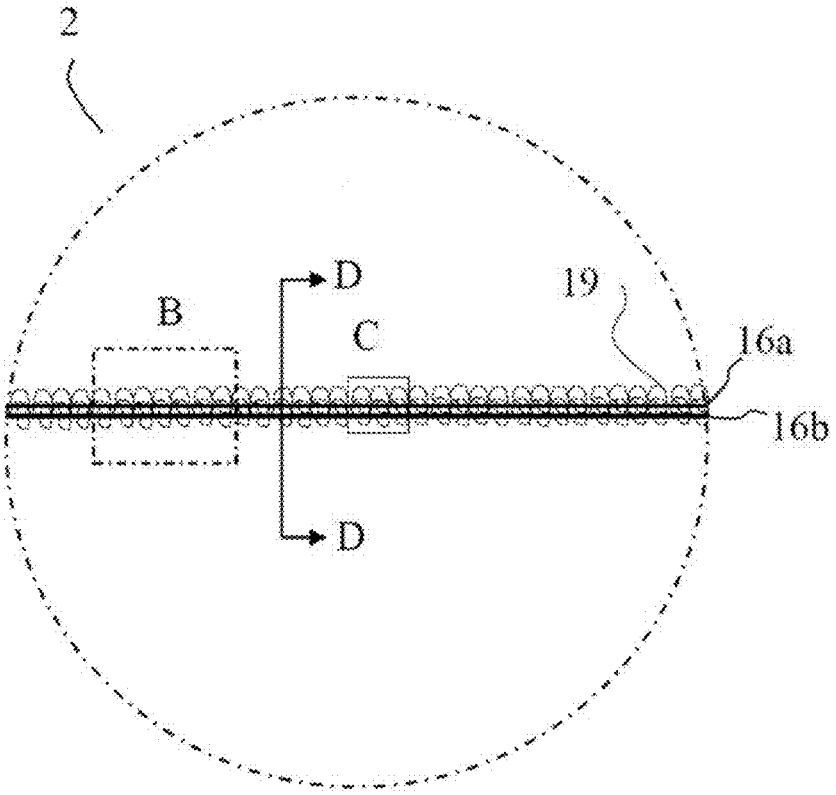
FIG. 2A shows the structural illustration of the composite yarn according to certain embodiments described herein.
Figure 2B:
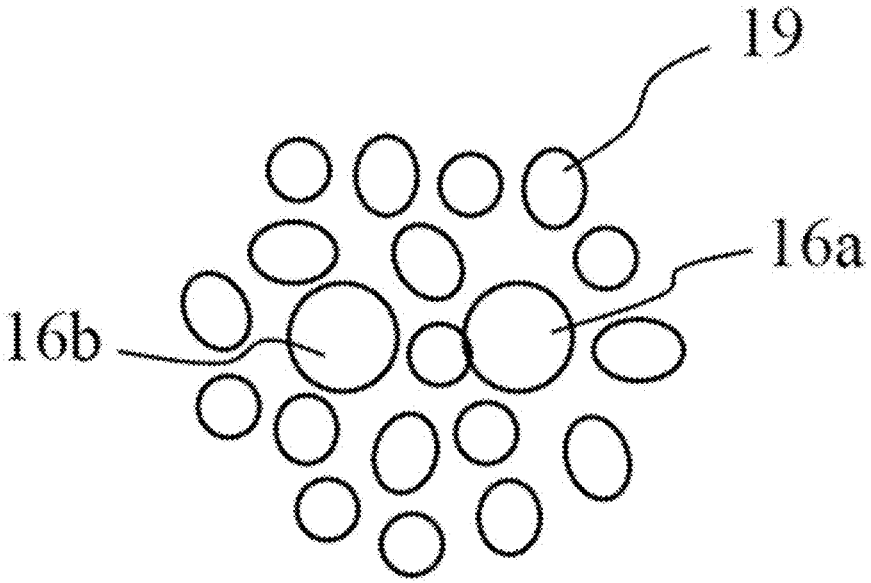
FIG. 2B shows the cross-sectional illustration at D-D of the composite yarn in FIG. 2A according to certain embodiments described herein.
Figure 7:
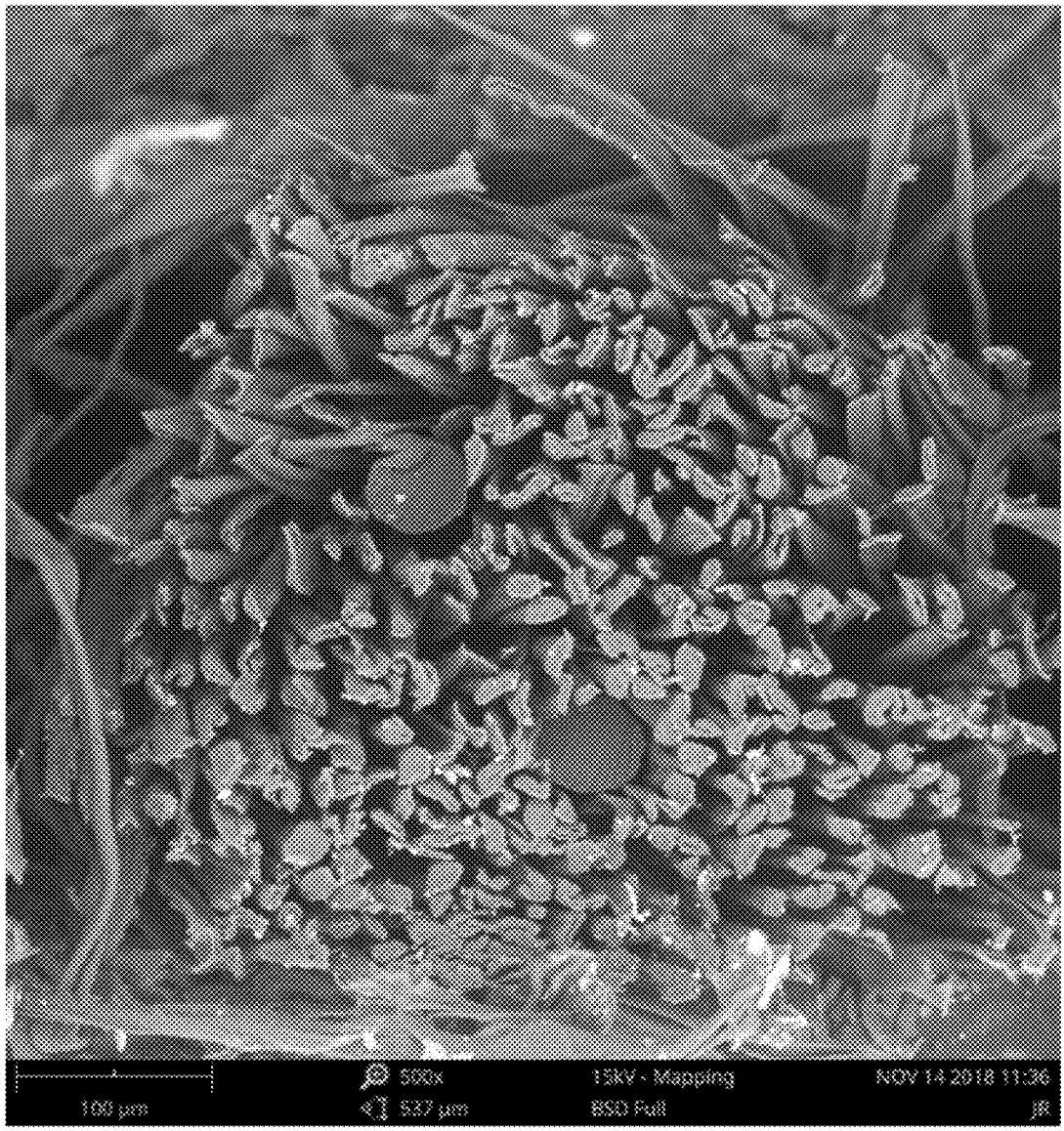
FIG. 7 shows the scanning electron microscopic image of the cross-section at D-D of the composite yarn according to certain embodiments described herein shown in FIG. 2A.

As shown in FIG. 2B and FIG. 7, the first body yarn 16*a* and the second body yarn 16*b* can be arranged in parallel without directly touching each other, and the first body yarn 16*a* and the second body yarn 16*b* are connected by the wrapping fibers 19 to form the composite yarn.

The composite yarns having the above-mentioned novel heterogeneous distribution of fibers have advantages over the existing composite yarns, such as low twist and therefore soft and fluffy hand touch, low yarn internal torque, and high strength.

The following non-limiting examples are illustrative of the low-twist-high-strength composite yarns prepared using the methods in accordance with the invention (FIGS. 6A-6C and FIG. 7) and the low-twist composite yarns prepared using conventional methods:

EXAMPLES

Example 1: preparation of low-twist-high-strength composite yarn according to one embodiment of the present disclosure.

Two nylon filaments with a yarn count of 15 denier were fed into the front roller with a distance of 2.5 mm at the front roller. The rayon was fed into the back roller and was output between the two nylon filaments from the front roller. The two nylon filaments and the rayon were preliminarily twisted in the twisting triangle region before entering the false twisting device for false twisting, followed by outfeeding from the false twisting device to form the composite yarn, which was then further twisted and wound by the winding device. The yarn count (Ne) of the composite yarn is about 40.

Example 2: properties of the low-twist-high-strength composite yarn according to one embodiment of the present disclosure.

In the low-twist-high-strength composite yarn prepare according to Example 1, the yarn count of the first body yarn and the second body yarn respectively is 15 denier; the wrapping fibers are formed by the rayon, which takes up 77.5% of the total weight of the composite yarn. The twist factor of the composite yarn is 1.5, wherein the twist factor is calculated by dividing the number of twist per inch by the square root of the yarn count (Ne). The single yarn strength is 308 cN.

Example 3: preparation of the low-twist composite yarns using the conventional method as control yarn.

Two nylon filaments with a yarn count of 15 denier were fed into the front roller with a distance of 2.5 mm at the front roller. The rayon was fed into the back roller and was output between the two nylon filaments from the front roller. The two nylon filaments and the rayon were twisted in the twisting triangle region to form the composite yarn, which was then further twisted and wound by the winding device. The yarn count (Ne) of the composite yarn is about 40.

Example 4: properties of the low-twist composite yarn (control yarn).

In the low-twist composite yarn prepare according to Example 3, the yarn count of the first body yarn and the second body yarn respectively is 15 denier; the wrapping fibers are formed by the rayon, which takes up 77.5% of the total weight of the composite yarn. The twist factor of the composite yarn is 3.8, wherein the twist factor is calculated by dividing the number of twist per inch by the square root of the yarn count (Ne). The single yarn strength is 299 cN.

What is claimed is:

1. A method for preparing a composite yarn, comprising:

infeeding a first filament and a second filament into a front roller, the first filament and the second filament being separated by a distance at the front roller so that the first filament and the second filament form a twisting triangle region before entering a false twisting device;

infeeding at least one roving comprising a plurality of short fibers into a back roller, and outfeeding the at least one roving from the front roller at a position substantially in a middle of the distance between the first filament and the second filament at the front roller such that a portion of the short fibers randomly wraps around either or both of the first and the second filament when the at least one roving intertwines the first and the second filaments within the twisting triangle region while a remaining portion of the short fibers remains free;

infeeding the first filament, the second filament and the at least one roving into the false twisting device to form the composite yarn comprising a central yarn within the false twisting device, the first filament being a first body yarn, the second filament being a second body yarn, and the first body yarn and the second body yarn being arranged to form the central yarn of the composite yarn.

2. The method of claim 1, wherein the distance between the first and the second filaments at the front roller is from about 1.5 mm to about 3.5 mm.

3. The method of claim 1, wherein the yarn count (Ne) of the central yarn is 2.5 to 120.

4. The method of claim 1, wherein the wrapping directions of the portion of the short fibers wrapping around the first and the second filaments are the same.

5. The method of claim 1, further comprising twisting the first filament and the second filament during said infeeding the first filament, the second filament and the at least one roving into the false twisting device.

6. The method of claim 1, further comprising directly winding the composite yarn.

7. The method of claim 1, further comprising twisting while winding the composite yarn.

8. The method of claim 1, further comprising wrapping the remaining portion of the short fibers around the central yarn during formation of the composite yarn within the false twisting device.

9. The method of claim 8, wherein the portion of the short fibers randomly wrapping around the first filament or the second filament within the twisting triangle region is in a direction opposite to that of the remaining portion of the short fibers wrapping around the central yarn during said formation of the composite yarn at the false twisting device.

10. The method of claim 1, wherein the first and the second filaments have a twist factor greater than that of the composite yarn.

11. The method of claim 10, wherein the twist factor of the first and second filaments is greater than 0 whilst the twist factor of the composite yarn is substantially 0 with no loss or minimal loss in strength.

12. The method of claim 1, wherein the first and second filaments have a weight percentage of about 60% or more with respect to total weight of the composite yarn.

13. The method of claim 1, wherein the short fibers have a length of less than 28 mm.

* * * * *